US005240378A

United States Patent [19]

Janisse et al.

[11] Patent Number: 5,240,378

[45] Date of Patent: Aug. 31, 1993

[54] SPACE EFFICIENT FAN GUARD

[75] Inventors: Dwight C. Janisse; Jay R. Janisse, both of Troy, Mich.

[73] Assignee: Dwight C. Janisse & Associates, Inc., Troy, Mich.

[21] Appl. No.: 864,803

[22] Filed: Apr. 7, 1992

[51] Int. Cl.[5] ..... F04D 29/70; B65D 85/68

[52] U.S. Cl. ..... 416/247 R; 206/320; 206/503; 206/523; 53/447; 53/472

[58] Field of Search ..... 416/247 R; 415/121.2; 206/319, 320, 503, 522, 523; 53/445, 447, 472, 474

[56] References Cited

U.S. PATENT DOCUMENTS

| | | | |
|---|---|---|---|
| 3,123,288 | 3/1964 | Franklin . | |
| 3,262,638 | 7/1966 | Militello . | |
| 3,402,882 | 9/1968 | Militello . | |
| 3,414,121 | 12/1968 | Suzuki . | |
| 3,787,142 | 1/1974 | Dupke . | |
| 4,166,531 | 9/1979 | Fujiwara | 206/320 |
| 4,369,760 | 1/1983 | Jorgenson et al. . | |
| 4,509,354 | 4/1985 | Suzuki et al. . | |
| 4,634,346 | 1/1987 | Cameron et al. . | |
| 4,657,485 | 4/1987 | Hartwig . | |
| 4,861,230 | 8/1989 | Broining . | |
| 4,953,698 | 9/1990 | Gregorish et al. . | |
| 5,002,462 | 3/1991 | Janisse . | |
| 5,033,711 | 7/1991 | Gregorish et al. . | |

*Primary Examiner*—Edward K. Look
*Assistant Examiner*—James A. Larson
*Attorney, Agent, or Firm*—Gossett Dykema

[57] ABSTRACT

A fan comprises a pair of guard halves which surround an impeller. One of the guard halves is smaller than the other guard half, such that the smaller of the two may be stacked within the larger to reduce the required space for packaging. Due to the inventive construction, the required space for packaging the guard is substantially reduced over prior art structures which have guard halves of approximately equal dimensions. Further, an inventive packing structure is disclosed wherein the individual components of a guard/impeller subassembly are securely packaged relative to each other. In particular, an impeller is positioned within the stacked guard halves, and secured at a relatively fixed positioned by resilient packing materials. The guard halves are preferably formed by a number of radially and circularly extending wires. A plurality of foam blocks are spaced in the stacked guard halves, at positions spaced from the impeller. When a second subassembly including a pair of guard halves is stacked within the first pair of guard halves, the wires forming the first and second pair of guard halves dig into these foam blocks, locking the two guard/impeller subassemblies relative to each other.

20 Claims, 2 Drawing Sheets 4
32
30
42
49
B
A
45
44
41
39
38
36
37
C
D
43
24
22
40
50
27
26
51
25
62
63
60
22

52

SPACE EFFICIENT FAN GUARD

BACKGROUND OF THE INVENTION

This application relates to an improved fan guard which reduces the necessary space and materials for packaging and shipping the guard, and to a unique packaging for a guard/impeller subassembly.

A known fan includes a fan guard having front and rear guard halves for surrounding a blade or impeller. In the known fan, the front and rear guard halves are substantially identical in size and construction. There are some structural differences between the two guard halves for mounting other portions of the fan. In one prior art fan, the two guard halves were secured together by numerous hooks. When the guard halves were stacked for shipping, often these hooks locked on adjacent guard halves, damaging the adjacent guard halves and making it very difficult to disassemble the stacked guard halves.

In an improved prior art fan, the front and rear guard halves are connected to each other by moving hinge members through sets of spaced aligned eyelets. Such a fan is disclosed in U.S. Pat. No. 5,002,462. The disclosure of this patent with regard to the structure of the fan, and in particular the application of the hinge members, is incorporated herein by reference.

It is known to pack the prior art fan guard/impeller subassemblies for shipment by placing one of the two guard halves within the other, and then placing the impeller within the uppermost of the guard halves. Since the prior art guard halves are of substantially the same size, the uppermost guard half is not fully received in the other guard half. This has resulted in a relatively large amount of space being required for packing the prior art guards. This is, of course undesirable. Further, the guard halves tend to bind together making separation difficult. Also, the prior art has not been able to pack plural guards in a single container without undesirable shipping damage. In particular, it has been difficult to adequately protect the impeller.

SUMMARY OF THE INVENTION

In a disclosed embodiment of the present invention, one of the guard halves is made smaller in circumference than the second, such that it can be received within the second when packed. The impeller may then be packed within the stacked guard halves. This reduces the amount of height necessary for packing a guard/impeller subassembly and offers substantial protection for the impeller. In a most preferred embodiment of the present invention, the smaller of the two guard halves has an outer peripheral surface spaced from a central axis by a distance which is approximately equal to the distance that an inner peripheral surface of the larger guard half is spaced from the axis. Thus, the smaller guard half can be received within the larger guard half.

In a preferred embodiment of the present invention, each of the guard halves has a flat generally circular central portion, an outer generally cylindrical portion, and a curved portion connecting the circular and cylindrical portions. The circular portion of the smaller guard half is smaller than the circular portion of the larger guard half, such that the smaller guard half may be fully received within the larger guard half when packed. The curved portions of the larger and smaller guard halves are preferably curved about similar arcs. In a most preferred embodiment of the present invention, eyelets extend radially outwardly from the cylindrical portions to receive hinge members. The eyelets from the smaller guard half extend radially outwardly from a central axis to the same extent as the eyelets from the larger guard half, such that they may be aligned when the guard halves are assembled in the resultant fan.

In a method of stacking guard/impeller subassemblies according to the present invention, the larger guard half is initially placed within a cardboard packing container. The smaller guard half is then placed within the larger. A cushioning foam pad may then be centered within the smaller guard half. The impeller may then be placed within the smaller guard half, with the impeller shaft hub resting on the foam pad. Spacers may then be placed about the impeller. A cardboard cylinder may be placed on the impeller shaft hub, and bubble packaging material may be placed above this cylinder. Additional guard/impeller subassemblies may be placed on top of this first guard/impeller subassembly in the same manner. The second guard/impeller subassembly encloses and protects the first impeller. Further, the unique packaging ensures that the guard/impeller subassemblies remain relatively fixed during shipping. Since the smaller guard half is basically wholly received within the larger guard half, the overall height required for stacking each individual guard/impeller subassembly is substantially reduced over the prior art guard/impeller subassemblies. Further, the smaller guard half makes unstacking of the guards easier.

These and other features of the present invention can be best understood from the following specification and drawings, of which the following is a brief description.

DETAILED DESCRIPTION OF A PREFERRED EMBODIMENT

Figure 1:
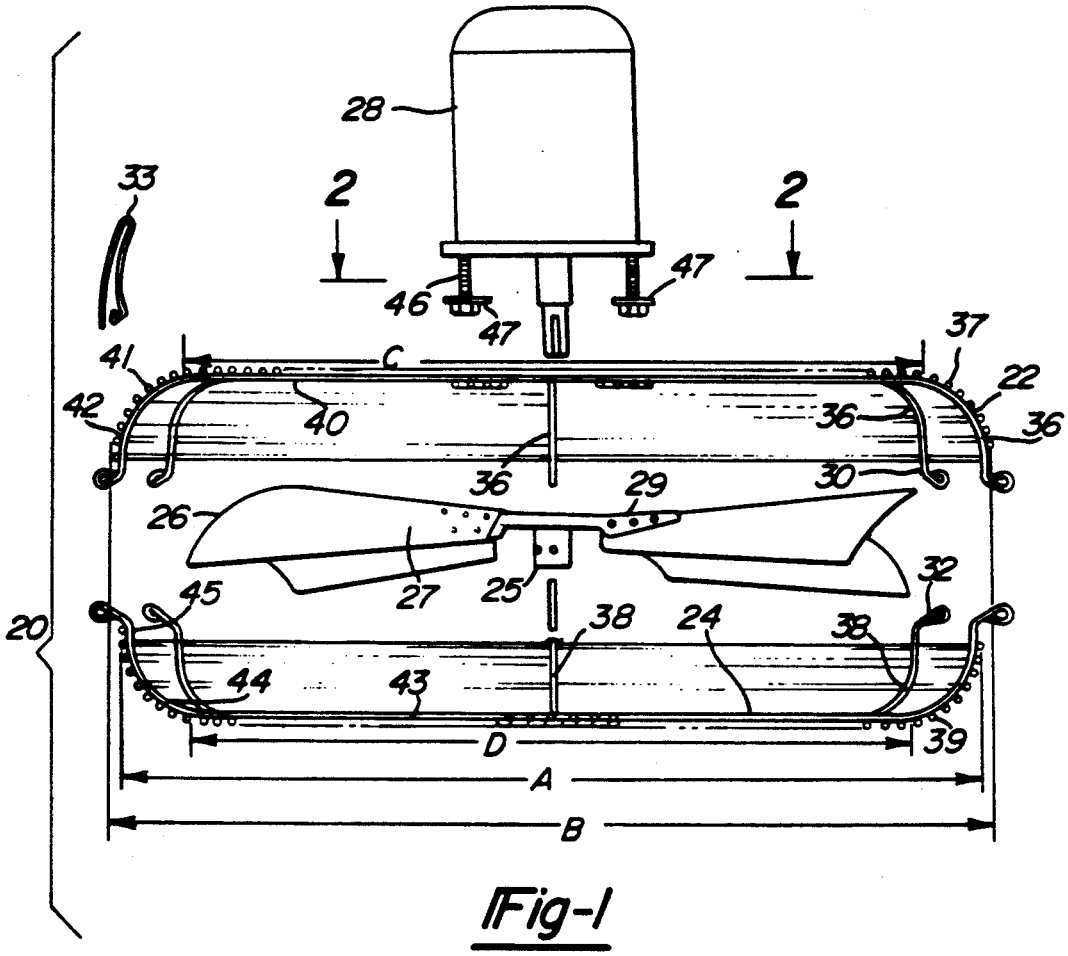
FIG. 1 is an assembly view of a fan according to the present invention.

A fan assembly 20 illustrated in FIG. 1 incorporates a rear guard half 22 and a front guard half 24 surrounding an impeller 26. Impeller 26 has a number of blades 27 connected to a shaft hub 25 by a spider 29. An electric motor 28 is connected to rear guard half 22 to drive impeller 26. The basic structure for mounting motor 28 and impeller 26 to the fan guard halves 22 and 24 is as disclosed in the U.S. Pat. No. 5,002,462. As shown, a plurality of eyelets 30 are also formed on rear guard half 22, and eyelets 32 are formed on front guard half 24. Eyelets 30 and 32 receive hinges 33 to perform a function fully disclosed in the previously mentioned United States Patent. Eyelets 30 and 32 are radially spaced from a rotational axis of impeller 26 by approximately the same distance, such that they are easily aligned.

Rear guard half 22 is formed by a plurality of radially extending wire members 36 defining an inner peripheral surface for rear guard 22, and a plurality of circular concentric wire members 37 which define an outer peripheral surface for rear guard half 22. Similarly, radially extending wires 38 define an inner peripheral surface for front guard half 24, while concentrically extending wires 39 define an outer peripheral surface for front guard half 24. A distance A is defined as the diametric distance between the outer peripheral surface of circularly extending wires 39 at a rearwardmost end of front guard half 24. Similarly, distance B is the diametric distance between outer peripheral surfaces of circularly extending wires 37 at a forwardmost end of rear guard half 22. As shown, distance B is slightly greater than distance A. The inner peripheral surface of radially extending wires 36 on rear guard half 22 is spaced from a central axis by a distance that is approximately equal to the distance between the outer peripheral surfaces of front guard half 24 and the same axis. Thus, front guard half 24 may be wholly received within rear guard half 22. As will be explained below, this reduces the space necessary for packing a subassembly which includes the guard.

Rear guard half 22 can be said to be defined by a generally flat circular portion 40, a generally curved portion 41, and a cylindrical portion 42. Circular portion 40 extends for a diameter identified by distance C. Similarly, front guard half 24 has a generally flat circular portion 43, a curved portion 44, and a cylindrical portion 45. Circular portion 43 extends for a diameter identified by dimension D. As shown, dimension D is smaller than dimension C; again so that front guard half 24 may be wholly received within rear guard half 22 to reduce the necessary packing space.

Figure 2:
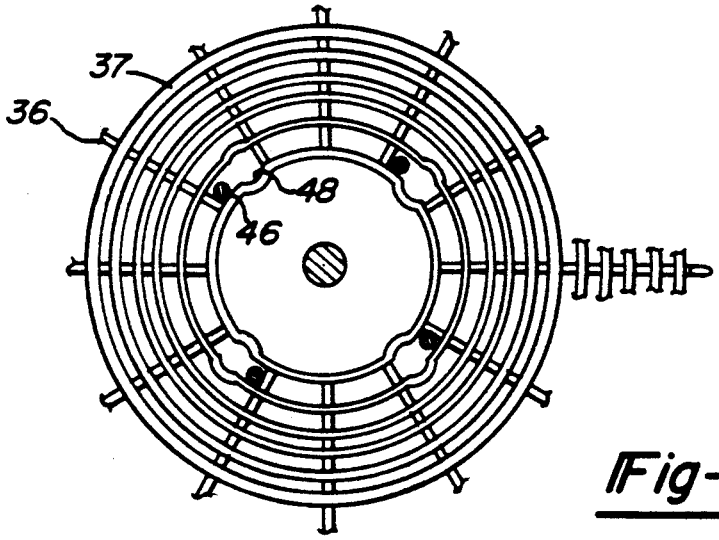
FIG. 2 is a cross-sectional view along line 2—2 as shown in FIG. 1.

As also shown in FIG. 1, motor 28 has a plurality of mounting screws 46 with premounted serrated flange nuts 47. As shown in FIG. 2, rear guard half 22 has slots 48 which define a proper position for receiving mounting screws 46 and flange nuts 47 of motor 28. The motor 28 may then be rotated such that flange nuts 47 are not aligned with slots 48. The flange nuts 47 are tightened, locking the motor 28 to the rear guard half 22.

Figures 3, 4:
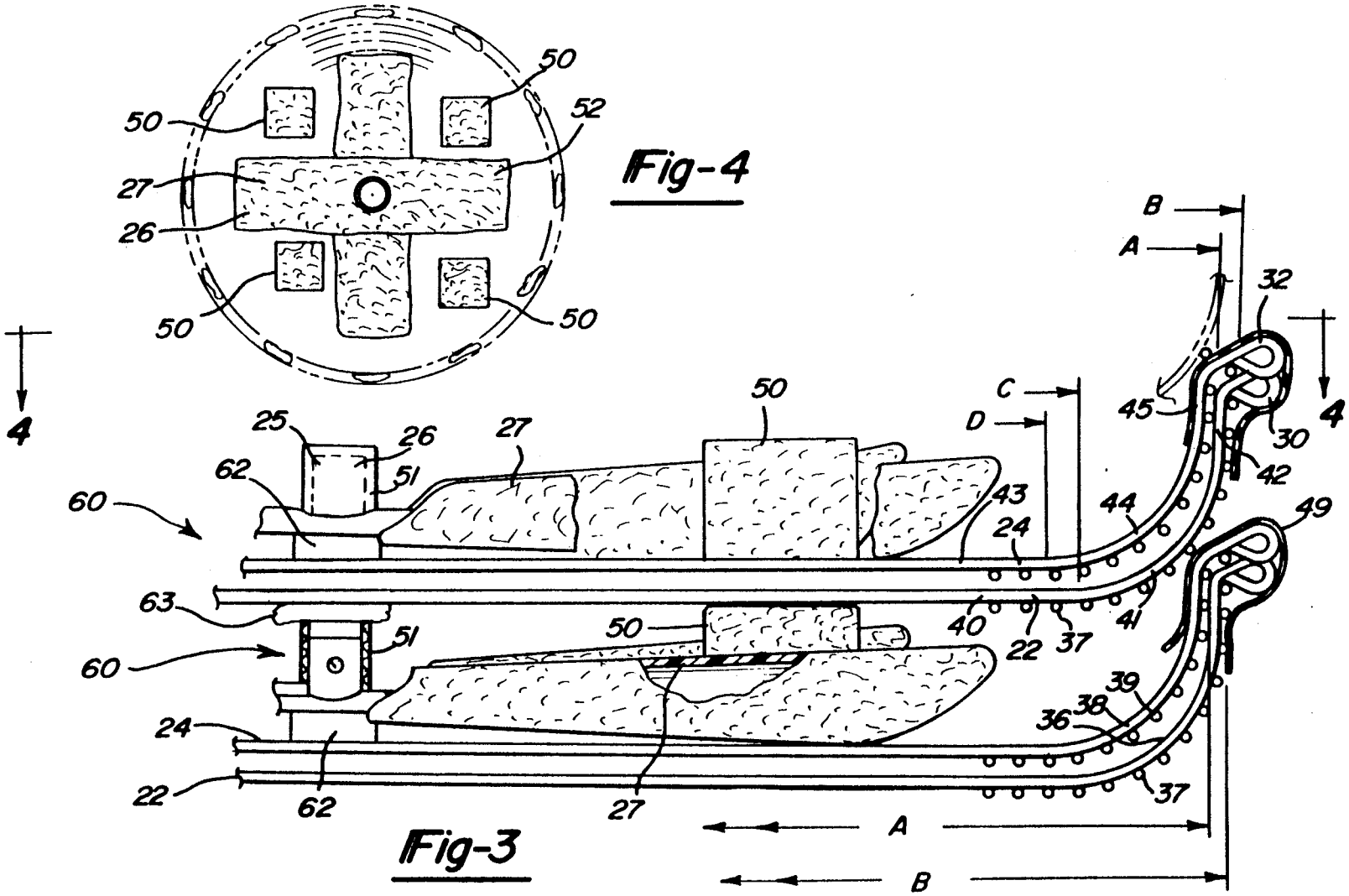
FIG. 3 is an enlarged partial view through a package containing several guard/impeller subassemblies.
FIG. 4 is a view along line 4—4 as shown in FIG. 3.

As shown in FIG. 3, since front guard half 24 is smaller than rear guard half 22, it may be received within rear guard half 22 for shipping and storage of the unassembled fan guard halves. As also shown, since circular portion 43 of front guard half 24 is of a smaller diameter than circular portion 40 of rear guard half 22, curved portion 44 begins at a position spaced radially inwardly from the position where curved portion 41 begins. Thus, curved portion 44 fits within curved portion 41. Further, cylindrical portion 45 of front guard half 24 has an outer peripheral diameter which is approximately equal to the inner peripheral diameter of cylindrical portion 42 of rear guard half 22. Thus, rear guard half 22 receives front guard half 24, reducing the space necessary for packaging a guard/impeller subassembly 60 which includes impeller 26 and guard halves 22 and 24. As further shown, eyelet 30 on rear guard half 22 is spaced from the center axis of the fan assembly by approximately the same radial distance as eyelet 32 associated with the smaller front guard half 22. In this way, it is still relatively easy to align the eyelets 30 and 32 when assembling the resultant fan.

In a method of packaging, rear guard half 22 is initially placed within a container and front guard half 24 is then positioned within rear guard half 22. Preferably, a cardboard shipping container is used. Protector members 49, preferably a resilient foam material, may be positioned over the aligned eyelets 30 and 32. A foam block or pad 62 is placed in the front guard half, and impeller 26 may then be placed within front guard half 24 with shaft hub 25 and spider 29 resting on foam pad 62. Foam pad 62 cushions spider 29 thereby taking pressure off the blades 27. Foam spacers 50 may be placed between blades 27, protecting impeller 26 and providing proper spacing and leveling of the next guard/impeller subassembly 60. Cylinder 51, preferably cardboard, may be placed over shaft hub 25 to further secure guard/impeller subassembly 60. Bubble material 63 may be placed on cylinder 51 to cushion between adjacent guard/impeller subassemblies 60, and provide a downward force to capture cylinder 51, and lock impeller 26 at a desired location. Another guard/impeller subassembly 60 may then be placed on top of the first. This encloses and protects the lower impeller, substantially reducing shipping damage. Several additional subassemblies 60 can be placed within the same container in a similar manner. Preferably, the container contains six or twelve subassemblies.

The wires 37 and 39 from the two guard halves dig into foam spacers 50 locking the two guard/impeller subassemblies 60 together, thus preventing the two subassemblies from sliding or slipping relative to each other during shipping. Since front guard half 24 is effectively wholly received within rear guard half 22, the height necessary for packaging each guard/impeller subassembly 60 is substantially at a minimum. This is invaluable in the shipping and storage of a number of subassemblies, reducing required packaging materials and expense. Further, due to the smaller guard half, unstacking is also made easier.

As shown in FIG. 4, preferably four spacers 50 are utilized and are spaced between the blades on impeller 26. Spacers 50 may be formed of a suitable foam. Impeller blades 27 may be covered by a protective sleeve 52 formed of foam or bubble material.

In one embodiment, diameter A is approximately ¾ inch smaller than diameter B on 24 and 30 inch diameter fans. Further, diameter D is approximately ¾ inch smaller than diameter C. A 24 inch fan subassembly of the prior art construction requires a 7¼ inches package. The inventive construction requires only 5 inches when packed with one subassembly per container. The prior art could not pack plural blade/impeller subassemblies in a single package without risking damage, and in particular damage to the impeller. The inventive fan guard, packaging method and assembly is able to package plural blade/impeller subassemblies in a single package. In particular, with the inventive fan guard and packaging assembly, six subassemblies may be packaged within a 19½ inch tall package. This can be compared to the old method of packaging the subassembly which would have required six individual packages, for a total of 43½ inches. Similarly, the inventive subassemblies can be packaged in a group of twelve subassemblies in a 36¾ inches tall single package. Again, the prior art fan would have required twelve individual packages, for a total height of 87 inches. These are significant reductions. The reductions would result in savings in shipping costs, required storeroom size and required packaging materials.

A preferred embodiment of the present invention has been disclosed, however, a worker of ordinary skill in the art would recognize that certain modifications would come within the scope of this invention. For that reason, the following claims should be studied in order to determine the true scope and content of this invention.

We claim:

1. A fan assembly comprising:

an impeller adapted to rotate about an axis; and a guard surrounding said impeller, said guard comprising a pair of guard halves, a first of said guard halves having an outer peripheral surface spaced from said axis of said impeller by a distance that is less than the distance that an outer peripheral surface of a second of said guard halves is spaced from said axis.

2. A fan assembly as recited in claim 1, wherein a cross-section of each said guard half defined by a diametric plane extending perpendicular to said axis has cylindrical portions which contact each other, each of said guard halves having curved portions extending from said cylindrical portions to generally flat circular portions.

3. A fan assembly as recited in claim 2, wherein said circular portion of said first guard half has an outer diameter that is less than the outer diameter of said circular portion of said second guard half.

4. A fan assembly as recited in claim 3, wherein a plurality of eyelets extend radially outwardly from said cylindrical portions of both said guard halves, said eyelets on both said first and second guard halves extending to locations which are spaced equally from said rotational axis of said impeller.

5. A fan assembly as recited in claim 4, wherein a hinge member connects said eyelets on said first and second guard halves.

6. A fan assembly as recited in claim 5, wherein the inner diameter of said second guard half is approximately equal to the outer diameter of said first guard half at corresponding locations on said cross-sections.

7. A fan assembly as recited in claim 2, wherein a plurality of eyelets extend radially outwardly from said cylindrical portions of both said guard halves, said eyelets on both said first and second guard halves extending to locations which are spaced equally from said rotational axis of said impeller.

8. A fan assembly as recited in claim 1, wherein each of said guard halves is constructed of a plurality of radially extending wires defining an inner peripheral surface, and a plurality of concentric circularly extending wires defining an outer peripheral surface of said fan guards.

9. A method of packing at least a first fan guard/impeller subassembly comprising the steps of:

(1) providing a pair of guard halves, with a first guard half having an outer peripheral surface spaced from a central axis by a distance which is less than the distance by which an outer peripheral surface of a second guard half is spaced from said central axis; and (2) placing said second guard half in a packaging container, placing said first guard half within said second guard half, and placing an impeller within said first guard half.

10. The method as recited in claim 9, wherein a second fan guard/impeller subassembly is placed upon the first fan guard/impeller subassembly, with the second fan guard/impeller subassembly being packaged in the manner required by claim 9.

11. The method as recited in claim 10, wherein a foam block is inserted between said impeller and said first guard half, prior to placing said impeller in said first guard half, and a further resilient structure is placed between said impeller and said second subassembly.

12. The method as recited in claim 11, wherein said first and second guard halves of both first and second fan guard/impeller subassemblies are formed by a plurality of wires, and foam blocks are placed in said first guard half of said first fan guard/impeller subassembly at positions spaced from said impeller, said foam blocks extending for a height greater than a distance between the first and said second fan guard/impeller subassemblies, such that the wires on said first guard half of said first fan guard/impeller subassembly and the wires on said second guard half of said second fan guard/impeller subassembly dig into said foam blocks, locking said first and second guard/impeller subassemblies relative to each other.

13. A package comprising:

a first pair of guard halves each centered about central axes, a first of said guard halves having an outer peripheral surface spaced from said central axis of said guard halves by a distance which is approximately equal to the distance by which an inner peripheral surface of a second of said guard halves is spaced from said central axis, both said guard halves having a circular central portion, a curving portion extending from said circular portion, and a cylindrical portion extending from said curving portion, said circular portion of said first guard half having an outer diameter which is less than the outer diameter of said circular portion of said second guard half, such that said first guard half is received within said second guard half.

14. A package as recited in claim 13, wherein an impeller is also placed within said first guard half of said first pair of guard halves, and a second pair of guard halves is placed outwardly of said impeller relative to said first pair of guard halves, wherein said second pair of guard halves has a first guard half and a second guard half which are defined in the same manner as the first pair of guard halves in claim 13.

15. A package as recited in claim 14, wherein in both guard half pairs a foam block is placed between said impeller and said first guard half, and a resilient member is placed between said impeller in said first pair of guard halves, and said second pair of guard halves, to secure said impeller within said first pair of guard halves.

16. A package as recited in claim 14, wherein said first and second pairs of guard halves are each formed by a plurality of radially extending wires defining an inner peripheral surface and a plurality of concentric circularly extending wires defining an outer peripheral surface, said package further containing a plurality of foam blocks being placed within said first pair of guard halves, and extending for a height that is greater than the distance between an inner peripheral surface of said first guard half in said first pair of guard halves, and the outer peripheral surface of the second guard half in said second pair of guard halves, such that said wires which form said guard halves dig into said foam blocks, locking said first and second pairs of guard halves relative to each other.

17. A package comprising:

a first pair and a second pair of guard halves each centered about central axes and each pair of guard halves having a first guard half and a second guard half, each first guard half having an outer peripheral surface spaced from said central axis by a distance which is approximately equal to the distance by which an inner peripheral surface of the second guard half forming that pair is spaced from said central axis, both said first and second guard halves of said first and second pairs of guard halves having a circular central portion, a curving portion extending from said circular portion, and a cylindrical portion extending from said curving portion, said circular portion of each said first guard half having an outer diameter which is less that the outer diameter of said circular portion of said second guard half forming that pair, such that said first guard half is received within said second guard half forming that pair;

an impeller received within said first guard half of said first pair of guard halves, wherein said second pair of guard halves are placed outwardly of said impeller relative to said first pair of guard halves;

a first foam block placed between said impeller and said first guard half of said first pair of guard halves, and a resilient member placed between said impeller in said first pair of guard halves and said second pair of guard halves to secure said impeller within said first pair of guard halves; and each of said first and second guard halves of said first and second pairs of guard halves being formed by a plurality of radially extending wires defining an inner peripheral surface, and a plurality of concentric circularly extending wires defining an outer peripheral surface, a plurality of second foam blocks being placed within said first pair of guard halves, and extending for a height that is greater than the distance between the inner peripheral surface of said first guard half in said first pair of guard halves and the outer peripheral surface of the second guard half in said second pair of guard halves, such that said wires which form said guard halves dig into said second foam blocks, locking said first and second pairs of guard halves relative to each other.

18. A package as recited in claim 17, wherein there are at least one additional pair of guard halves packed within said package.

19. A package as recited in claim 18, wherein there are six pairs of guard halves packed within said package.

20. A package as recited in claim 18, wherein there are twelve pairs of guard halves packed within said package.

* * * * *